US009429397B1

(12) United States Patent
Hill

(10) Patent No.: US 9,429,397 B1
(45) Date of Patent: Aug. 30, 2016

(54) SYSTEM, DEVICE, AND METHOD FOR DETECTION OF PROJECTILE TARGET IMPACT

(71) Applicant: Kevin W. Hill, Brownsburg, IN (US)

(72) Inventor: Kevin W. Hill, Brownsburg, IN (US)

( * ) Notice: Subject to any disclaimer, the term of this patent is extended or adjusted under 35 U.S.C. 154(b) by 0 days.

(21) Appl. No.: 14/633,641

(22) Filed: Feb. 27, 2015

(51) Int. Cl.
*A63B 63/00* (2006.01)
*F41J 5/06* (2006.01)
*F41J 5/14* (2006.01)

(52) U.S. Cl.
CPC .... *F41J 5/06* (2013.01); *F41J 5/14* (2013.01)

(58) Field of Classification Search
USPC ..... 273/371
See application file for complete search history.

(56) References Cited

U.S. PATENT DOCUMENTS

| | | | | |
|---|---|---|---|---|
| 3,778,059 | A | 12/1973 | Rohrbaugh | |
| 4,261,579 | A | 4/1981 | Bowyer | |
| 4,282,453 | A | 8/1981 | Knight | |
| 4,349,728 | A | 9/1982 | Phillips | |
| 4,514,621 | A | 4/1985 | Knight | |
| 5,025,424 | A | 6/1991 | Rohrbaugh | |
| 5,095,433 | A | 3/1992 | Botarelli | |
| 5,551,876 | A | 9/1996 | Koresawa | |
| 5,577,733 | A | 11/1996 | Downing | |
| 6,109,614 | A | 8/2000 | Ciarcia | |
| 8,523,185 | B1 | 9/2013 | Gilbreath | |
| 8,570,499 | B2 | 10/2013 | Walti-Herter | |
| 8,925,925 | B2 * | 1/2015 | Hodge | 273/348 |
| 2002/0045999 | A1 * | 4/2002 | Bollweg | F41G 3/2683 702/158 |
| 2012/0074645 | A1 * | 3/2012 | Hodge | F41J 7/04 273/127 D |
| 2014/0313346 | A1 | 10/2014 | Huang | |

FOREIGN PATENT DOCUMENTS

| | | | |
|---|---|---|---|
| WO | 9805971 | A2 | 2/1998 |

* cited by examiner

*Primary Examiner* — Pierre E Elisca
(74) *Attorney, Agent, or Firm* — IDP Patent Services; Olav M. Underdal

(57) ABSTRACT

A system for adaptable and portable target impact detection includes: a target impact detector, including a sensor array and a sensor control unit; and a target control device; such that the sensor control unit calculates an impact location on a shooting target, and a user can interact with the target impact detector, via use of the target control device, in order to view information about target impacts, and in order to calibrate the target impact detector. A sensor control unit includes a processor; a non-transitory memory; an input/output component; a sensor array controller; a targeting calculator; a sensor calibrator; and a data bus. Also disclosed is a method for target impact detection, including: positioning target impact detector, selecting static calibration, shooting projectile, measuring shockwave, calculating estimated target impact, determining dynamic calibration, and calculating improved target impact.

20 Claims, 7 Drawing Sheets

Target Impact Detector Installation

Target Impact Detector

System for Target Impact Detection

Sensor Control Unit

Target Control Device

Target Impact Calculation Parameters

SYSTEM, DEVICE, AND METHOD FOR DETECTION OF PROJECTILE TARGET IMPACT

CROSS-REFERENCE TO RELATED APPLICATIONS

N/A

FIELD OF THE INVENTION

The present invention relates generally to the field of target shooting, and more particularly to methods, devices and systems for detecting the position of an impact of a projectile on a target.

BACKGROUND OF THE INVENTION

A shooter cannot always determine impact location of a projectile when shooting at a target. This can be due to many issues; some of which are:

a. That it is too far to have adequate visibility to target even with advanced optics;
b. That there are too many holes in the target already. This is a common issue in a practice environment with or without a second person involved; or
c. That the shooter is off-target and cannot determine where his bullet is, relative to the target. Even having a second person as a spotter cannot always adequately provide enough information to get the shooter on target.

Current systems for detecting impacts of a projectile on a target are generally difficult and complex to install. Often, they are large, self-contained target/detector units that discourage portability.

Some solutions surround a target with sensors, and require permanent installation. In addition, many solutions are only suitable for smaller targets.

Yet other known solutions, consist of complete targeting systems that require an "acoustic chamber" for detection of projectile while eliminating adjacent noises. The sensors are usually in the corners of the acoustic chamber, and in some cases require a very specific setup where sensors are clamped to the target in multiple quadrants or corners.

Generally, a calibration routine will need to be utilized in any of the above systems to provide increased accuracy based on setup orientation and target center location/orientation.

As such, considering the foregoing, it may be appreciated that there continues to be a need for novel and improved systems, devices and methods for detecting impacts of a projectile on a target

SUMMARY OF THE INVENTION

The foregoing needs are met, to a great extent, by the present invention, wherein in aspects of this invention, enhancements are provided to the existing models for detecting the location of projectile impacts on a target.

In an aspect, system for target impact detection can include:

a. a target impact detector, which can further include:
   i. a sensor array, and
   ii. a sensor control unit, which is connected to the sensor array;

such that the target impact detector is positioned in a measurement plane parallel to and in proximity to the plane of a target, as part of a target impact detector installation;

such that the sensor control unit is configured with a static calibration corresponding to the target impact detector installation, such that the sensor control unit calculates an estimated projectile impact location on a target based on a calculated projectile position in a measurement plane, via use of the static calibration, based on measurements from sensors in the sensor array.

In a related aspect, the system for target impact detection can further include: a target control device, which communicates with the sensor control unit via a network, such that a user interacts with the target impact detector, via use of the target control device, in order to view information about target impacts, and in order to calibrate the target impact detector.

In a related aspect, the sensor control unit can include dynamic calibration, such that the sensor control unit calculates a corrected projectile impact location on a target via a dynamic calibration calculation, whereby the dynamic calibration calculation corrects for installation deviations and ballistic anomalies.

In a related aspect, the target control device can communicate with the sensor control unit via a wireless network.

In a related aspect, the target control device can be a mobile app executing on a mobile phone.

In a related aspect, the target impact detector can be used to solve the problems referenced above. The target impact detector can be placed safely adjacent to a target. This could be at any orientation provided it is parallel to the plane of the target. For example, the target impact detector can be deployed below the target with the sensing direction vertical from apparatus. Some shooting ranges may have a more protected zone allowing placement of the apparatus in an area providing protection to the unit itself from impact of a projectile.

In a related aspect, the target impact detector significantly reduces setup time and possibility of being impacted by a projectile. The target impact detector can be self-contained and can conveniently be placed on the ground in front of the target, or it can be attached to a target frame, as are commonly found in many established shooting ranges that are setup for competitions.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
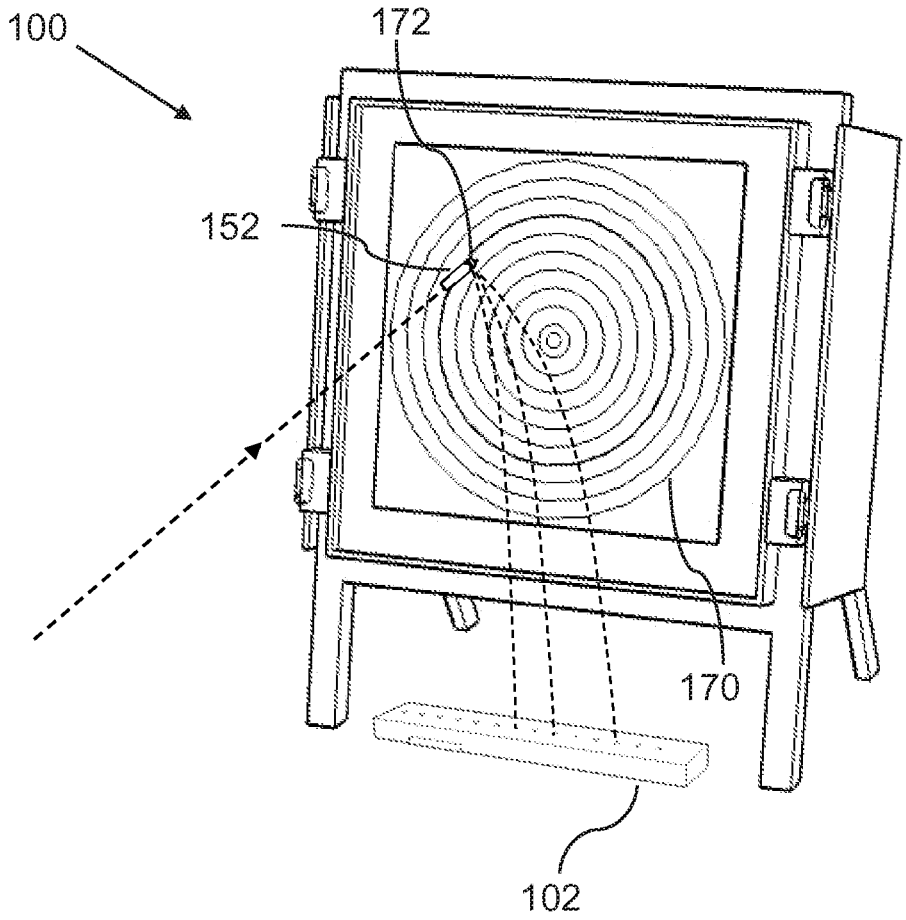
FIG. 1 is a perspective view of a target impact detector installation, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a target impact detector installation 100 with reference to FIG. 1, in such manner that like reference numerals refer to like components throughout; a convention that we shall employ for the remainder of this specification.

In an embodiment, FIG. 1 shows a perspective view of an installation of a target impact detector 102 positioned in front of a target 170, configured such that the target impact detector can measure acoustic shockwave data from a projectile passing by, and thereby calculate an impact location 172 on the target 170.

The target impact detector 102 includes a linear array of sensors to detect the supersonic 'crack' of a projectile 152 as it passes by the target impact detector 102. Each sensor is triggered at a corresponding time interval, which is employed to calculate an estimated impact location 172.

Figure 2:
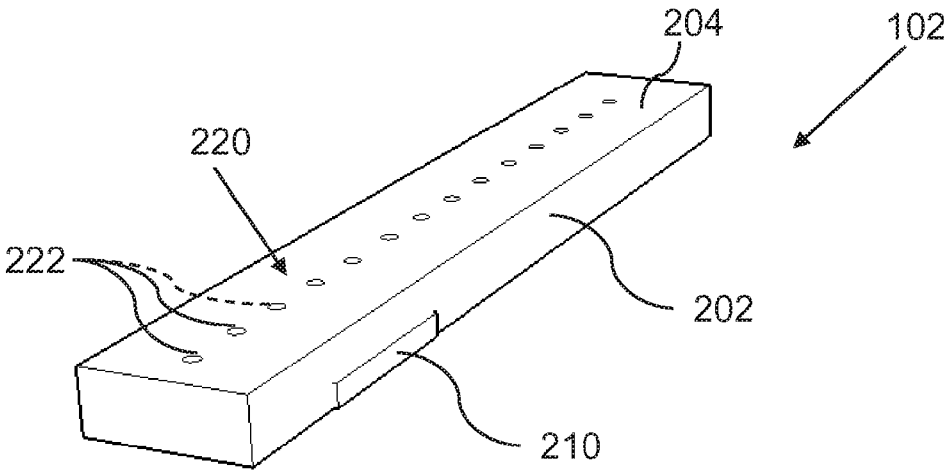
FIG. 2 is a top perspective view of a target impact detector, according to an embodiment of the invention.

In a related embodiment, as illustrated in FIG. 2, the target impact detector 102 can include:

a. A detector enclosure 202, which is elongated, and typically substantially rectangular, optionally with rounded edges;

b. A sensor array 220, further including at least 2 sensors 222, which are arranged linearly in the elongated direction of the detector enclosure 202, such the sensor array 220 is inbuilt or connected to an upper side 204 of the target impact detector 102; and c. A sensor control unit 210; which is built in to the detector enclosure 202, such that the sensor control unit 210 is connected to each sensor 222 in the sensor array 220;

wherein the sensor control unit 210 is configured to calculate an impact location 172, based on measurements from the sensors 222.

In various related embodiments, the sensor control unit 210 can be inbuilt in the detector enclosure 202, flush with a surface of the detector enclosure 202, or fully inside the detector enclosure 202, or mounted externally on a surface of the detector enclosure 202, or mounted in some other related configuration.

In a related embodiment, the sensors 222 can be acoustic sensors, such as various types of microphones, including ultrasonic microphones. The sensor 222 can also be a pressure sensor.

In various related embodiments, a varying array 220 of sensors can be configured to perform impact location 172 calculations:

a. If two sensors are used, the apparatus can detect and provide feedback to a shooter target puller/attendant regarding left vs. right position of impact 172;

b. Three sensors is the minimum to detect impact location 172 in a plane created by the sensor array.

c. Additional sensors can be added to achieve more statistical analysis and provide error diagnosis and detection. For example, if 8 out of 10 sensors detect the passing projectile, it can still be determined that a projectile indeed did pass by, even though, for any given reason, a couple of sensors did not detect it.

d. With more than three sensors, a passing projectile can more reliably be detected. Also, it is possible to perform averaging with statistical analysis by discarding any measurement anomalies outside of a predetermined threshold of standard deviation. Therefore, multiple sensors can allow both precision and accuracy to be improved.

In a related embodiment, a two-sensor configuration of the target impact detector 102 can have value in some shooting competitions. For example, at a shooting range without an impact berm it can be very difficult for a target puller to discern whether the sound of a projectile is related to his target, or instead is related to another shooter hitting an adjacent target.

In various related embodiments, the sensor array 220, can be configured as one linear row of sensors 222, as shown in FIG. 2, or the sensor array 220 can be configured as two, three, or more parallel linear rows of sensors 222, such that the sensor array 220 forms a matrix of sensors 222. Alternatively, the sensors 222 can be arranged in some other pattern in a two dimensional plane or in three dimensions.

Figure 3:
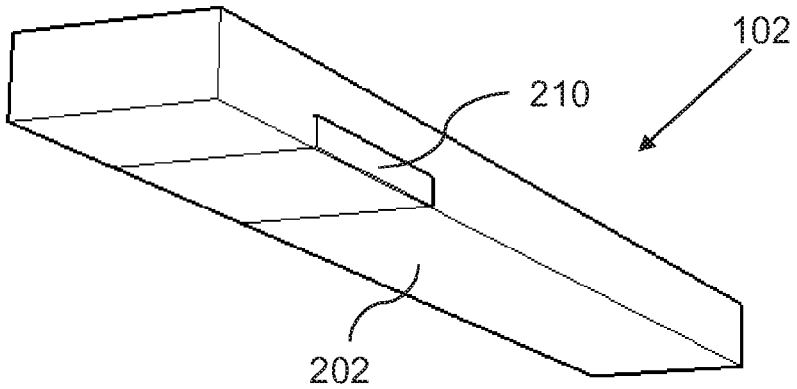
FIG. 3 is a bottom perspective view of a target impact detector, according to an embodiment of the invention.

In a related embodiment, FIG. 3 shows a bottom perspective view of the target impact detector 102.

Figure 4:
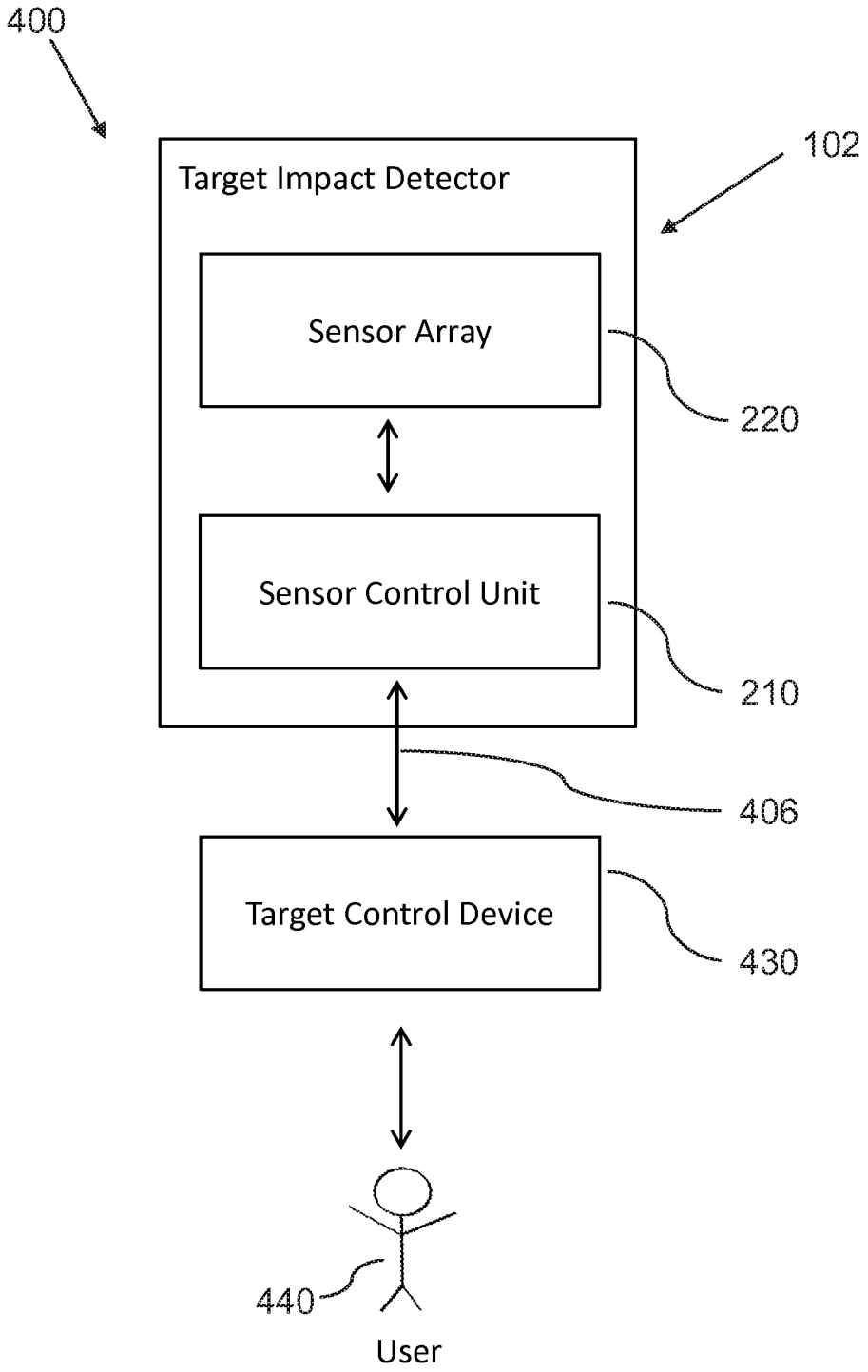
FIG. 4 is a schematic diagram illustrating a system for target impact detection, according to an embodiment of the invention.

In an embodiment, as illustrated in FIG. 4, a system for target impact detection 400 can include:

a. A target impact detector 102, further including:

i. A sensor array 220; and ii. A sensor control unit 210, which is connected to the sensor array 220; and b. A target control device 430, which can communicate with the sensor control unit 210 via a network 406;

wherein the sensor control unit 210 is configured to calculate the impact location 172, based on measurements from the sensor array 220; and wherein a user 440 can interact with the target impact detector 102, via use of the target control device 430, in order to view information about target impacts, and in order to calibrate the target impact detector 102.

Figure 5:
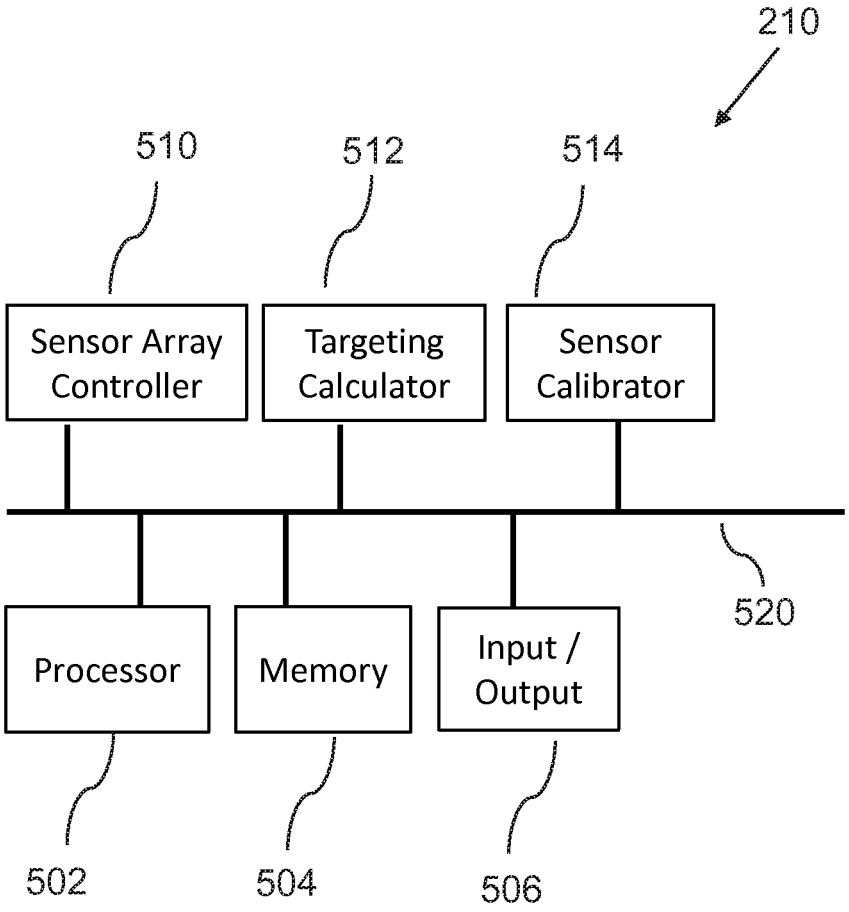
FIG. 5 is a schematic diagram illustrating a sensor control unit, according to an embodiment of the invention.
Figure 6:
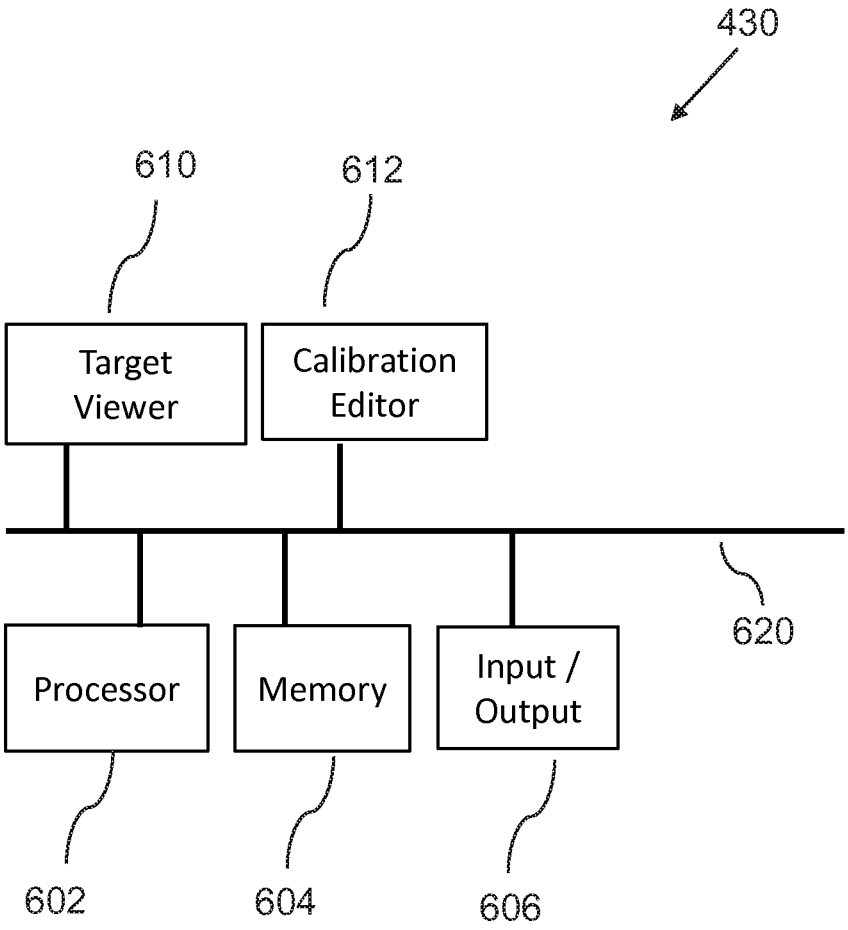
FIG. 6 is a schematic diagram illustrating a target control device, according to an embodiment of the invention.

In a related embodiment, as illustrated in FIG. 5, a sensor control unit 210 can include:

a. A processor 502;
b. A non-transitory memory 504;
c. An input/output component 506;
d. A sensor array controller 510;
e. A targeting calculator 512;
f. A sensor calibrator 514; all connected via
g. A data bus 520;

Wherein the sensor array controller 510, is configured to communicate with sensors 222, in order to obtain sensor measurements, such that the sensor measurements can be stored by the processor 502 in the memory 504;

Wherein the targeting calculator 512 can be configured to calculate an estimated projectile impact location 172, wherein the targeting calculation is based on the sensor measurements;

Wherein the sensor calibrator 514 is configured to determine calibration adjustment parameters by comparing estimated projectile impact locations calculated by the targeting calculator 512, with observed target impact locations, such that the calibration adjustment parameters adjust the calculation of the targeting calculator 512.

Figure 8:
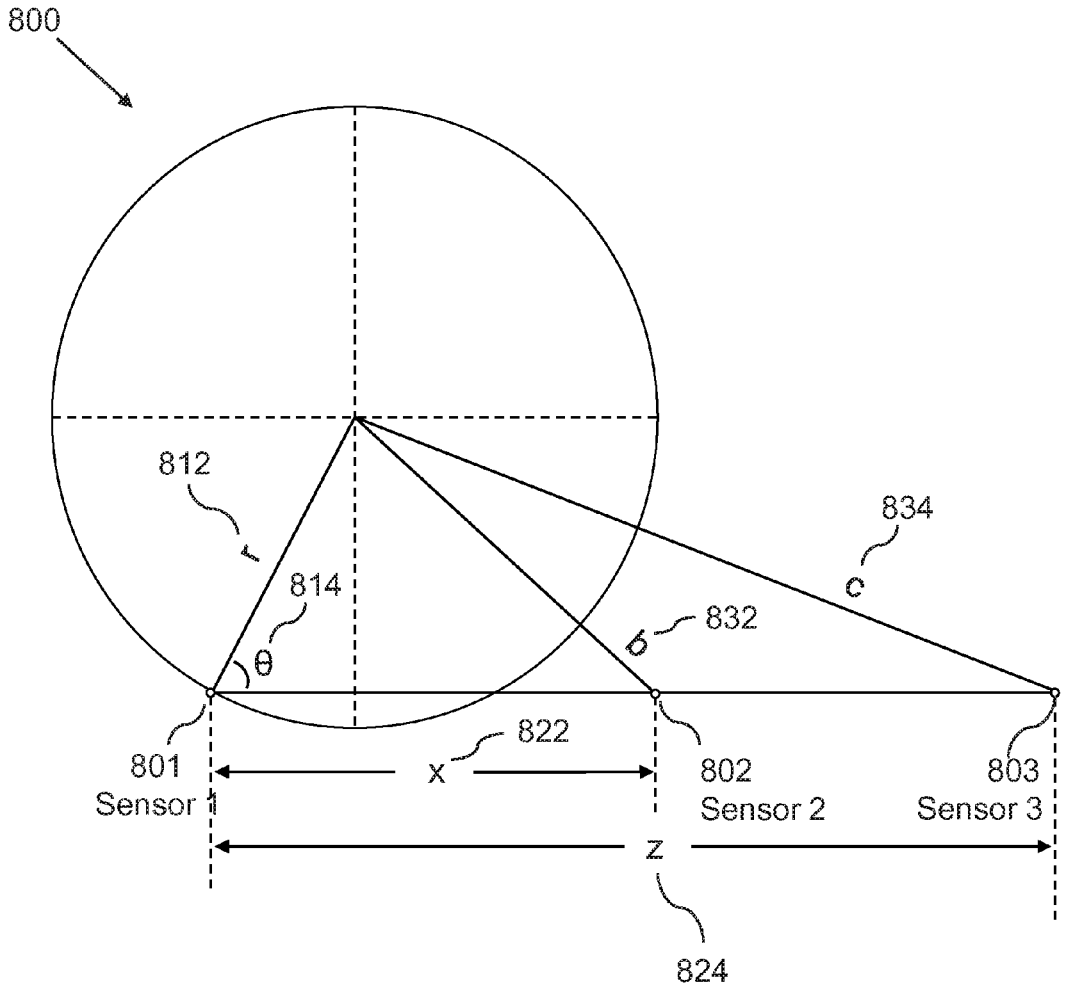
FIG. 8 is a schematic diagram illustrating parameters for target impact calculation, according to an embodiment of the invention.

In a related embodiment, as illustrated in FIG. 8, the targeting calculator 512 can be configured to calculate a position of the projectile in a measurement plane in front of the target plane, such that the measurement plane is parallel to the target plane of the target, and such that the sensors 222 are located in the measurement plane.

The unknown variables, which determine the location of the projectile, relative to the position of the first sensor 801, are:

a. r 812, the distance from the projectile location in the measurement plane to the first sensor 801, and
b. θ 814, the angle between the vector line from the first sensor 801 to the projectile location, and the vector line of the sensors 801 802 803.

The known or calculated parameters are:

a. X 822, the distance between the first sensor 801 and the second sensor 802;
b. z 824, the distance between the first sensor 801 and the third sensor 803;
c. b 832, the additional distance to the second sensor 802, such that b 832 plus r 812 equal the distance from the projectile location in the measurement plane to the second sensor 802;
d. c 834, the additional distance to the third sensor 803, such that c 834 plus r 812 equal the distance from the projectile location in the measurement plane to the third sensor 803.

In a related embodiment, the targeting calculator 512 can be configured to calculate a position of the projectile in the measurement plane, such that:

$$r = \frac{-z^2x + zx^2 + c^2x - b^2z}{2(bz - cx)}$$

and $$\theta = \alpha\cos\left(\frac{x^2 + r^2 - (r+b)^2}{2xr}\right)$$

In a related embodiment, if the measurement plane is not substantially equal to the target plane, the impact position of the projectile in the target plane can be calculated as an affine transformation from the position in the measurement plane to the position in the target plane.

In a related embodiment, for installation wherein the measurement plane is not substantially equal to the target plane, pre-determined static calibrations can be configured for standardized target detector installations of the target impact detector positioned on ground in front of a target, for example configured such that the target impact detector 102 is positioned on level ground, 2 meters in front of the target plane, such that the first sensor 801 is positioned with a perpendicular projection line, to the left border of the target, and such that predetermined calibrations corresponding to the standardized target detector installation with a shooting distance of for example 10, 25, 50, 200, 300, 500, and 1000 meters, with a specific pre-determined calibration for each shooting distance, based on a shooter positioned at the perpendicular projection line from the center of the target, substantially at the height of the center of the target. The pre-determined calibration is calculated as an affine transformation from the position in the measurement plane to the position in the target plane.

In a related embodiment, a dynamic calibration can be configured to correct for on-site deviations and ballistic anomalies. This can for example correct for off-center position of a shooter, either to the right or left and/or below or above the level and perpendicular projection line from the center of the target. Similarly, the dynamic calibration can correct for side wind and/or up and down draft. The dynamic calibration is calculated as an affine transformation from a calculated impact position 172 in the target plane to an observed impact position 172 in the target 170 plane.

In a related embodiment, an affine transformation, T, of the calculated position, p, a vector in the plane, from a center point of the target 170, can be defined as:

$$T(p)=Mp+d \qquad \text{a.}$$

Where M is a 2-by-2 linear transformation matrix and d is a constant addition vector. A static or dynamic calibration is thereby determined by 6 constants, the 4 constants of M, and the two constants of d.

In other related embodiments, the transformation attached with a static and/or dynamic calibration can be a non-linear transformation in the plane.

In related embodiments, a static or dynamic calibration can be calculated based on a set of calculated and observed impact positions 172, using well-known numerical equation solving algorithms or systems, such as for example provided by Matlab™ or Mathematica™. Static or dynamic calibrations that are affine transformations can be calculated analytically by elementary methods in the field of linear algebra, well known to those with ordinary skill in the art. An affine transformation can be calculated with three sets of calculated and observed impact positions 172. Trivially, an affine transformation consisting only of a displacement (or addition) vector can be calculated with one set of calculated and observed impact positions 172, and is calculated as the difference vector.

In a related embodiment, a target control device 430 can include:

a. A processor 602;
b. A non-transitory memory 604;
c. An input/output 606;
d. A target viewer 610; and
e. A calibration editor 612; all connected via
f. A data bus 620;

Wherein a user can view calculated target impact locations on a graphical user display, obtained from communication with the sensor control unit 210 of the target impact detector 102; and wherein a user can enter observed target impact locations correlating with calculated target impact locations, such that the observed target impact locations can be communicated to the sensor control unit 210 of the target impact detector 102.

In related embodiments, the target control device 430 can be configured as:

a. A mobile app, executing on a mobile device, such as for example an Android phone or iPhone, or any wearable mobile device;
b. A tablet app, executing on a tablet device, such as for example an Android or iOS tablet device;
c. A web application, executing in a Web browser;
d. A desktop application, executing on a personal computer, or similar device;
e. An embedded application, executing on a processing device, such as for example Google Glass™, a smart TV, a game console or other system.

It shall be understood that an executing instance of an embodiment of the system for target impact detection 400, as shown in FIG. 4, can include a plurality of target control devices 430, which are each tied to one or more users 440.

Similarly, an executing instance of an embodiment of the system for target impact detection 400 can include a plurality of target impact detectors 102.

Figure 7:
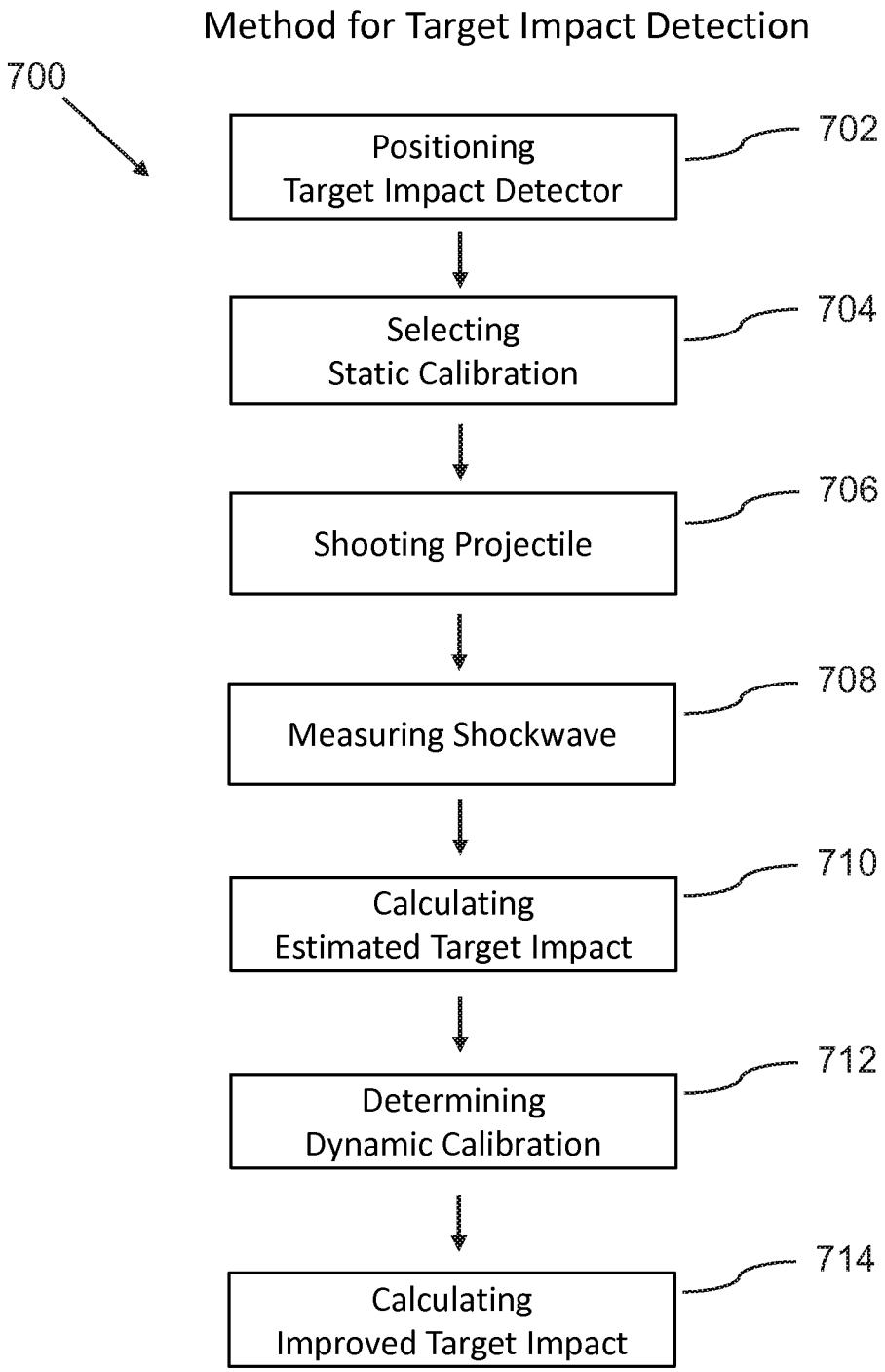
FIG. 7 is a flowchart illustrating steps that may be followed, in accordance with one embodiment of a method or process of target impact detection.

In an embodiment, as illustrated in FIG. 7, a method for target impact detection 700, can include:

a. Positioning a target impact detector 702, wherein a target impact detector is positioned by a target, such that an elongated direction of the target impact detector is parallel to a plane of the target, and such that the target impact detector can be on the ground or mounted to a side of the target, and such that the target impact detector can be located in the plane of the target or in front of the target plane;
b. Selecting a static calibration 704, wherein a static calibration that matches with the positioning of the target impact detector relative to the target is selected from a set of predetermined static calibrations;
c. Shooting projectile 706, wherein a projectile is shot in direction of the target, such that it passes the target impact detector before impacting with the target;
d. Measuring shockwave 708, wherein measurements are obtained from acoustic sensors, measuring a shockwave from the projectile as it passes the target impact detector;
e. Calculating estimated target impact 710, an optional step or act, wherein an estimated projectile impact location on the target is calculated based on a calculated projectile position in a measurement plane, via use of the static calibration, based on measurements from sensors in the sensor array;
f. Determining a dynamic calibration 712, wherein calibration adjustment parameters are determined by comparing the estimated projectile impact location with an observed target impact location, such that the calibration adjustment parameters adjust the calculation of the targeting calculator, such that the estimated projectile impact location corresponds to the observed target impact location; and
g. Calculating an improved target impact 714, wherein a corrected projectile impact location on a target is calculated based on the estimated projectile impact location in the target plane, via a dynamic calibration calculation using the calibration adjustment parameters, whereby the dynamic calibration calculation corrects for installation deviations and ballistic anomalies.

FIGS. 1-6 are block diagrams and flowcharts, methods, devices, systems, apparatuses, and computer program products according to various embodiments of the present invention. It shall be understood that each block or step of the block diagram, flowchart and control flow illustrations, and combinations of blocks in the block diagram, flowchart and control flow illustrations, can be implemented by computer program instructions or other means. Although computer program instructions are discussed, an apparatus or system according to the present invention can include other means, such as hardware or some combination of hardware and software, including one or more processors or controllers, for performing the disclosed functions.

In this regard, FIGS. 1-5 depict the computer devices of various embodiments, each containing several of the key components of a general-purpose computer by which an embodiment of the present invention may be implemented. Those of ordinary skill in the art will appreciate that a computer can include many components. However, it is not necessary that all of these generally conventional components be shown in order to disclose an illustrative embodiment for practicing the invention. The general-purpose computer can include a processing unit and a system memory, which may include various forms of non-transitory storage media such as random access memory (RAM) and read-only memory (ROM). The computer also may include nonvolatile storage memory, such as a hard disk drive, where additional data can be stored.

It shall be understood that the above-mentioned components of the sensor control unit 210 and the target control device 430 are to be interpreted in the most general manner.

For example, the processors 502 602, can each respectively include a single physical microprocessor or microcontroller, a cluster of processors, a datacenter or a cluster of datacenters, a computing cloud service, and the like.

In a further example, the non-transitory memory 504 and the non-transitory memory 604 can each respectively include various forms of non-transitory storage media, including random access memory and other forms of dynamic storage, and hard disks, hard disk clusters, cloud storage services, and other forms of long-term storage. Similarly, the input/output 506 and the input/output 606 can each respectively include a plurality of well-known input/output devices, such as screens, keyboards, pointing devices, motion trackers, communication ports, and so forth.

Furthermore, it shall be understood that the sensor control unit 210 and the target control device 430 can each respectively include a number of other components that are well known in the art of general computer devices, and therefore shall not be further described herein. This can include system access to common functions and hardware, such as for example via operating system layers such as Windows, Linux, and similar operating system software, but can also include configurations wherein application services are executing directly on server hardware or via a hardware abstraction layer other than a complete operating system.

An embodiment of the present invention can also include one or more input or output components, such as a mouse, keyboard, monitor, and the like. A display can be provided for viewing text and graphical data, as well as a user interface to allow a user to request specific operations. Furthermore, an embodiment of the present invention may be connected to one or more remote computers via a network interface. The connection may be over a local area network (LAN) wide area network (WAN), and can include all of the necessary circuitry for such a connection.

In a related embodiment, the target control device 430 communicates with the sensor control unit 210 over a network 406, which can include the general Internet, a Wide Area Network or a Local Area Network, or another form of communication network, transmitted on wired or wireless connections. Wireless networks can for example include Ethernet, Wi-Fi, Bluetooth, ZigBee, and NFC. The communication can be transferred via a secure, encrypted communication protocol.

Typically, computer program instructions may be loaded onto the computer or other general-purpose programmable machine to produce a specialized machine, such that the instructions that execute on the computer or other programmable machine create means for implementing the functions specified in the block diagrams, schematic diagrams or flowcharts. Such computer program instructions may also be stored in a computer-readable medium that when loaded into a computer or other programmable machine can direct the machine to function in a particular manner, such that the instructions stored in the computer-readable medium produce an article of manufacture including instruction means that implement the function specified in the block diagrams, schematic diagrams or flowcharts.

In addition, the computer program instructions may be loaded into a computer or other programmable machine to cause a series of operational steps to be performed by the computer or other programmable machine to produce a computer-implemented process, such that the instructions that execute on the computer or other programmable machine provide steps for implementing the functions specified in the block diagram, schematic diagram, flowchart block or step.

Accordingly, blocks or steps of the block diagram, flowchart or control flow illustrations support combinations of means for performing the specified functions, combinations of steps for performing the specified functions and program instruction means for performing the specified functions. It will also be understood that each block or step of the block diagrams, schematic diagrams or flowcharts, as well as combinations of blocks or steps, can be implemented by special purpose hardware-based computer systems, or combinations of special purpose hardware and computer instructions, that perform the specified functions or steps.

As an example, provided for purposes of illustration only, a data input software tool of a search engine application can be a representative means for receiving a query including one or more search terms. Similar software tools of applications, or implementations of embodiments of the present invention, can be means for performing the specified functions. For example, an embodiment of the present invention may include computer software for interfacing a processing element with a user-controlled input device, such as a mouse, keyboard, touch screen display, scanner, or the like. Similarly, an output of an embodiment of the present invention may include, for example, a combination of display software, video card hardware, and display hardware. A processing element may include, for example, a controller or microprocessor, such as a central processing unit (CPU), arithmetic logic unit (ALU), or control unit.

The many features and advantages of the invention are apparent from the detailed specification, and thus, it is intended by the appended claims to cover all such features and advantages of the invention, which fall within the true spirit and scope of the invention.

For example, alternative embodiments can reconfigure or combine the components of the sensor control unit 210 and the target control device 430. Parts or all of the components of the target control device 430 can be configured to operate in the sensor control unit 210, whereby the target control device 430 for example can function as a thin client, performing only graphical user interface presentation and input/output functions. Alternatively, parts or all of the components of the sensor control unit 210 can be configured to operate in the target control device 430.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A system for target impact detection, comprising:

a. a target impact detector, further comprising:

i. a sensor array; and ii. a sensor control unit, which is connected to the sensor array;

wherein the target impact detector is positioned in a measurement plane parallel to a target plane of a target, as part of a target impact detector installation;

wherein the sensor control unit is configured with a static calibration corresponding to the target impact detector installation, such that the sensor control unit is configured to calculate an estimated projectile impact location on a target based on a calculated projectile position in a measurement plane, via use of the static calibration, based on measurements from sensors in the sensor array.

2. The system for target impact detection of claim 1, further comprising:

a target control device, which communicates with the sensor control unit via a network;

wherein a user interacts with the target impact detector, via use of the target control device, in order to view information about target impacts, and in order to calibrate the target impact detector.

3. The system for target impact detection of claim 2, wherein the target control device further comprises:

a. a processor;

b. a non-transitory memory;

c. an input/output; and d. a target viewer; all connected via e. a device data bus;

wherein the target viewer is configured such that a user views calculated target impact locations on a graphical user display, obtained from communication with the sensor control unit of the target impact detector.

4. The system for target impact detection of claim 2, wherein the target control device further comprises:

a calibration editor;

wherein the calibration editor is configured such that a user enters observed target impact locations correlating with calculated target impact locations, such that the observed target impact locations are communicated to the sensor control unit.

5. The system for target impact detection of claim 1, wherein the sensor control unit is further configured with a dynamic calibration, such that the sensor control unit is further configured to calculate a corrected projectile impact location on a target based on the estimated projectile impact location in the target plane, via a dynamic calibration calculation, whereby the dynamic calibration calculation corrects for installation deviations and ballistic anomalies.

6. The system for target impact detection of claim 5, wherein the dynamic calibration is an affine transformation.

7. The system for target impact detection of claim 1, wherein the network is a wireless network.

8. The system for target impact detection of claim 1, wherein the target control device is configured as a mobile app executing on a mobile phone.

9. The system for target impact detection of claim 1, wherein the sensor array is comprised of at least 3 sensors, which are configured in one line.

10. The system for target impact detection of claim 1, wherein the sensor control unit further comprises:

a) a processor;

b) a non-transitory memory;

c) an input/output component;

d) a sensor array controller;

e) a targeting calculator; and f) a sensor calibrator;

wherein the sensor array controller is configured to communicate with the sensors of the sensor array, in order to obtain sensor measurements, such that the sensor measurements are stored by the processor in the memory;

wherein the targeting calculator is configured to process a targeting calculation to calculate an estimated projectile impact location, wherein the targeting calculation is based on the sensor measurements;

wherein the targeting calibrator is configured to determine calibration adjustment parameters by comparing estimated projectile impact locations calculated by the targeting calculator, with observed target impact locations, such that the calibration adjustment parameters adjust the calculation of the targeting calculator, such that the estimated projectile impact location corresponds to the observed target impact location.

11. The system for target impact detection of claim 1, wherein the static calibration is an affine transformation.

12. The system for target impact detection of claim 1, wherein the measurement plane is substantially equal to the target plane.

13. A target impact detector, comprising:

a. a sensor array, further comprising at least 2 sensors; and b. a sensor control unit, which is connected to the sensor array;

wherein the target impact detector is positioned in a measurement plane parallel to a target plane of a target, as part of a target impact detector installation;

wherein the sensor control unit is configured with a static calibration corresponding to the target impact detector installation, such that the sensor control unit is configured to calculate an estimated projectile impact location on a target based on a calculated projectile position in a measurement plane, via use of the static calibration, based on measurements from sensors in the sensor array.

14. The target impact detector of claim 13, wherein the sensor control unit further comprises:

a) a processor;

b) a non-transitory memory;

c) an input/output component;

d) a sensor array controller;

e) a targeting calculator; and f) a sensor calibrator; all connected via g) a control unit data bus;

wherein the sensor array controller is configured to communicate with the sensors of the sensor array, in order to obtain sensor measurements, such that the sensor measurements are stored by the processor in the memory;

wherein the targeting calculator is configured to process a targeting calculation to calculate an estimated projectile impact location, wherein the targeting calculation is based on the sensor measurements;

wherein the targeting calibrator is configured to determine calibration adjustment parameters by comparing estimated projectile impact locations calculated by the targeting calculator, with observed target impact locations, such that the calibration adjustment parameters adjust the calculation of the targeting calculator.

15. The target impact detector of claim 13, wherein the sensor array is comprised of at least 3 sensors, which are configured in one line.

16. The target impact detector of claim 13, further comprising a detector enclosure, wherein the sensor array is attached to a top surface of the detector enclosure and the sensor control unit is built into the detector enclosure.

17. A method for target impact detection, comprising:

a. positioning a target impact detector, wherein a target impact detector is positioned in a measurement plane, such that an elongated direction of the target impact detector is parallel to a plane of the target;

b. selecting a static calibration, wherein a static calibration that matches with the positioning of the target impact detector relative to the target is selected from a set of predetermined static calibrations;

c. shooting projectile, wherein a projectile is shot in direction of the target, such that it passes the target impact detector before impacting with the target;

d. measuring shockwave, wherein measurements are obtained from sensors in the target impact detector, wherein the sensors are measuring a shockwave from the projectile as it passes the target impact detector;

e. calculating estimated target impact, an optional step or act, wherein an estimated projectile impact location on the target is calculated based on a calculated projectile position in the measurement plane, via use of the static calibration, based on measurements from the sensors.

18. The method for target impact detection of claim 17, further comprising:

determining a dynamic calibration, wherein calibration adjustment parameters are determined by comparing the estimated projectile impact location with an observed target impact location, such that the calibration adjustment parameters adjust the calculation of the targeting calculator, such that the estimated projectile impact location corresponds to the observed target impact location.

19. The method for target impact detection of claim 18, further comprising:

calculating an improved target impact, wherein a corrected projectile impact location on a target is calculated based on the estimated projectile impact location in the target plane, via a dynamic calibration calculation using the calibration adjustment parameters, whereby the dynamic calibration calculation corrects for installation deviations and ballistic anomalies.

20. The method for target impact detection of claim 17, wherein the sensors are comprised of at least 3 acoustic sensors, which are configured in one line.

* * * * *